US007920801B2

(12) United States Patent
Otsuka et al.

(10) Patent No.: US 7,920,801 B2
(45) Date of Patent: Apr. 5, 2011

(54) IMAGE FORMING APPARATUS AND METHOD FOR CONTROLLING IMAGE FORMING APPARATUS

(75) Inventors: Masayuki Otsuka, Nara (JP); Katsuhiro Nagayama, Nara (JP); Takashi Kitagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 126 days.

(21) Appl. No.: 12/384,852

(22) Filed: Apr. 8, 2009

(65) Prior Publication Data

US 2009/0252516 A1 Oct. 8, 2009

(30) Foreign Application Priority Data

Apr. 8, 2008 (JP) ..... 2008-100270

(51) Int. Cl.
*G03G 15/00* (2006.01)
*G03G 15/08* (2006.01)

(52) U.S. Cl. ..... 399/55; 399/43

(58) Field of Classification Search ..... 399/55, 399/43

See application file for complete search history.

(56) References Cited

U.S. PATENT DOCUMENTS 7,668,474 B2 * 2/2010 Muranaka ..... 399/72
2007/0269228 A1 * 11/2007 Takeuchi et al. ..... 399/55 X

FOREIGN PATENT DOCUMENTS

JP 06-148973 5/1994
JP 2001-154434 6/2001
JP 2003-177638 6/2003
JP 2005-275119 A * 10/2005
JP 2008-003486 A * 1/2008
JP 2009-053397 A * 3/2009

OTHER PUBLICATIONS

Machine translation of JP 2003-177638 A dated Oct. 3, 2010.*

* cited by examiner

*Primary Examiner* — Sophia S Chen
(74) *Attorney, Agent, or Firm* — Edwards Angell Palmer & Dodge LLP; David G. Conlin; David A. Tucker

(57) ABSTRACT

Related is an image forming apparatus by electrophotography having a function of performing adjustment of image quality when performing image formation. The image forming apparatus includes a detection portion for detecting a fixing temperature of a fixing apparatus; a storage portion for storing an application history of a development bias; a count portion for counting a reposed time from a point when an operation of image formation is ended; a determination portion for determining a change range of the development bias immediately before the end of the operation of image formation; and an execution portion for executing adjustment of image quality by setting the development bias based on a determination result from the determination portion when the reposed time or the fixing temperature exceeds a predetermined value.

12 Claims, 6 Drawing Sheets

*FIG. 6*

(RELATIONSHIP BETWEEN DEVELOPER LIFE, POTENTIAL AND REPOSED TIME)

| DEVELOPER LIFE (1000 SHEETS) | REPOSED TIME INTERVAL (MIN) |
|---|---|
| ~10 | 60 |
| ~20 | 65 |
| ~30 | 70 |
| ~40 | 80 |
| ~50 | 90 |
| 50~ | 100 |

IMAGE FORMING APPARATUS AND METHOD FOR CONTROLLING IMAGE FORMING APPARATUS

This Nonprovisional application claims priority under 35 U.S.C. §119(a) on Patent Application No. 2008-100270 filed in Japan on 8 Apr. 2008, the entire contents of which are hereby incorporated by reference.

BACKGROUND OF THE INVENTION

1. Field of the Invention

The present invention relates to an image forming apparatus by electrophotography, such as a copier and a printer, and a method for controlling the image forming apparatus, particularly to an image forming apparatus having a function of adjusting image quality to stabilize printing quality and a method for controlling the image forming apparatus.

2. Description of the Prior Art

A conventional image forming apparatus by electrophotography is mounted with a developing apparatus for forming a toner image. The developing apparatus is roughly classified into one in mono-component developing system using mono-component toner and one in dual-component developing system using dual-component developer including mono-magnetic toner and magnetic carrier.

Since the developing apparatus in mono-component developing system is suitable for miniaturization but not suitable for high-speed development, most of high-speed and long-life image forming apparatuses employ the developing apparatus in dual-component developing system.

In this type of a developing apparatus using dual-component developer, carrier itself in dual-component developer is not consumed and remains in the apparatus, thus the carrier is not reduced, but toner is consumed by development and is reduced. Hence, in order to stabilize image quality, toner is appropriately supplied to maintain a constant toner concentration of dual-component developer.

Moreover, in the image forming apparatus, printing quality is changed influenced by deterioration of a photoreceptor or developer, change in the environmental condition, and the like, thus various technologies of adjusting image quality (referred to also as a process control technology) are disclosed in order to prevent the change in printing quality. In recent years, even when the image forming apparatus has not been used for a long time, these adjustment modes are performed.

As a conventional technology, proposed is an image forming apparatus in which adjustment of image quality is performed when returned from a reposed mode. Returning from the reposed mode means that an image formation engine portion has stopped until then, and, for example, in the case of dual-component developing system, agitating and charging of developer have not been performed for a certain time and the environmental condition, such as a temperature and a humidity under which the machine is installed, has been changed (difference in temperature/humidity in the morning and in the daytime, for example). When the environmental condition has been changed, a charge amount of developer, an electrical potential of a photoreceptor, or the like is considered to be changed. Due to such a change, change in image density or change in color tones is generated in printing processing after returning from the reposed, thus an image quality adjustment mode is executed to secure desired printing quality.

In addition, in the actual image quality adjustment mode, adjustment of an image density in the high density side and adjustment of a halftone density are performed, and in order to obtain optimum printing quality, it takes about 30 to 60 seconds to adjust the image quality. Particularly when a document of low printing rate is continuously printed, toner is hardly supplied, thus a charge amount of toner increases. Along with this, an operation is performed in the apparatus side so that a development bias is increased and an effective development potential is secured (a high development potential is obtained) in order to obtain a fixed image density or more.

However, since the charge amount of toner decreases when the apparatus has been reposed, an abnormally dense (high) image density is shown when development is performed in that state, thus the countermeasure thereto has been studied.

Hence, as a conventional technology 1, for example, disclosed is an image forming apparatus comprising: detection means for detecting adhered toner quantity as a toner image which is formed on a photoreceptor and has an almost highest image density in order to control the highest image density; developing means that is provided with a developer carrier which is rotated so as to feed developer and that visualizes an electrostatic latent image on the photoreceptor by adhering toner thereto; and image density adjustment means for adjusting an image density based on detection information of the detection means to a predetermined image density, wherein the image density adjustment means executes first adjustment in which a reference value of a rotational frequency of the developer carrier is changed according to a history of developer and second adjustment in which a changing amount of a development bias, which is applied when the highest image density is controlled, from the reference value is changed in accordance with the history of developer in different timings based on the history of developer (see Patent Literature 1: Japanese Patent Application Laid-Open No. 2001-154434).

In addition, as another conventional technology 2, disclosed is an image forming apparatus that optimizes a density control factor affecting an image density, in which, as a processing mode for optimizing the density control factor, a plurality of processing modes having different number of steps are configured so as to be selectively executable, and in addition, whether or not a reference concerning status change in the apparatus is satisfied is determined at the time of returning from a sleep, and a processing mode is selectively executed from the plurality of processing modes in accordance with the determination result (see Patent Literature 2: Japanese Patent Application Laid-Open No. 2003-177638).

However, in the conventional technology 1, adjustment is performed during a print job, which causes a problem that job efficiency is degraded. In addition, also in the conventional technology 2, since selection and execution of an optimum processing mode are performed in order to obtain desired printing quality when returning from a sleep mode, the process of selecting the processing mode is performed every time of returning from the sleep mode, which causes a problem that job efficiency is degraded.

SUMMARY OF THE INVENTION

The present invention has been made in view of the above-described conventional problems, and an object is to provide an image forming apparatus capable of adjusting image quality accurately by confirming previous print job information every time of returning from a reposed state and a method for controlling the image forming apparatus.

Followings show the image forming apparatus and the method for controlling the image forming apparatus according to the present invention to solve the above-described problems.

According to a first aspect of the present invention, an image forming apparatus by electrophotography having a function of performing adjustment of image quality when performing image formation, includes: a detection portion for detecting a fixing temperature of a fixing portion; a storage portion for storing an application history of a development bias; a count portion for counting a reposed time from a point when an operation of image formation is ended; a determination portion for determining a change range of the development bias immediately before the end of the operation of image formation; and an execution portion for executing adjustment of image quality by setting the development bias based on a determination result from the determination portion when the reposed time or the fixing temperature exceeds a predetermined value.

Furthermore, the present invention according to a second aspect is characterized in that, when the reposed time or the fixing temperature exceeds the predetermined value, the execution portion sets an effective development potential based on the determination result from the determination portion.

Furthermore, the present invention according to a third aspect is characterized in that the execution portion sets the development bias based on an average printing rate.

Furthermore, the present invention according to a fourth aspect is characterized in that the change range is a rise range.

Furthermore, the present invention according to a fifth aspect is characterized in that a setting portion for setting the predetermined value is included.

Furthermore, the present invention according to a sixth aspect is characterized in that the setting portion changes the predetermined value based on deterioration in developer.

Furthermore, according to a seventh aspect of the present invention, a method for controlling an image forming apparatus by electrophotography having a function of performing adjustment of image quality when performing image formation, including: a detection step of detecting a fixing temperature of a fixing portion; a storage step of storing an application history of a development bias; a count step of counting a reposed time from a point when an operation of image formation is ended; a determination step of determining a change range of the development bias immediately before the end of the operation of image formation; and an execution step of executing adjustment of image quality based on a determination result at the determination step when the reposed time or the fixing temperature exceeds a predetermined value.

Furthermore, the present invention according to an eighth aspect is characterized in that, when the reposed time or the fixing temperature exceeds the predetermined value, at the execution step, an effective development potential is set based on the determination result at the determination step.

Furthermore, the present invention according to a ninth aspect is characterized in that the development bias is set based on an average printing rate at the execution step.

Furthermore, the present invention according to a tenth aspect is characterized in that the change range is a rise range.

Furthermore, the present invention according to an eleventh aspect is characterized in that a setting step of setting the predetermined value is included.

Furthermore, the present invention according to a twelfth aspect is characterized in that the predetermined value is changed based on deterioration in developer at the setting step.

According to the first and seventh aspects of the present invention, it is possible to make a printing density after the image forming apparatus has been reposed being appropriate and to perform adjustment of image quality accurately, thus making it possible to always maintain excellent printing quality.

Furthermore, according to the second, third, eighth, and ninth aspects of the present invention, it is possible to make a printing density after the image forming apparatus has been reposed being appropriate and to always maintain excellent printing quality. Furthermore, according to the fourth and tenth aspects of the present invention, it is possible to maintain printing quality after recovering, particularly after printing of a document of a low printing rate has been continued.

Furthermore, according to the fifth and eleventh aspects of the present invention, a function of adjusting image quality can be executed depending on reposed environment, thus making it possible to maintain printing quality after recovering.

Furthermore, according to the sixth and twelfth aspects of the present invention, it is possible to correspond more in accordance with use of the image forming apparatus, thus making it possible to maintain printing quality after recovering.

BRIEF DESCRIPTION OF THE DRAWINGS

FIG. 6 is an illustrative view showing relationship of a life of developer and a setting value of a reposed time.

DESCRIPTION OF THE PREFERRED EMBODIMENTS

The best mode for carrying out the present invention will hereinafter be described with reference to the drawings.

Figure 1:
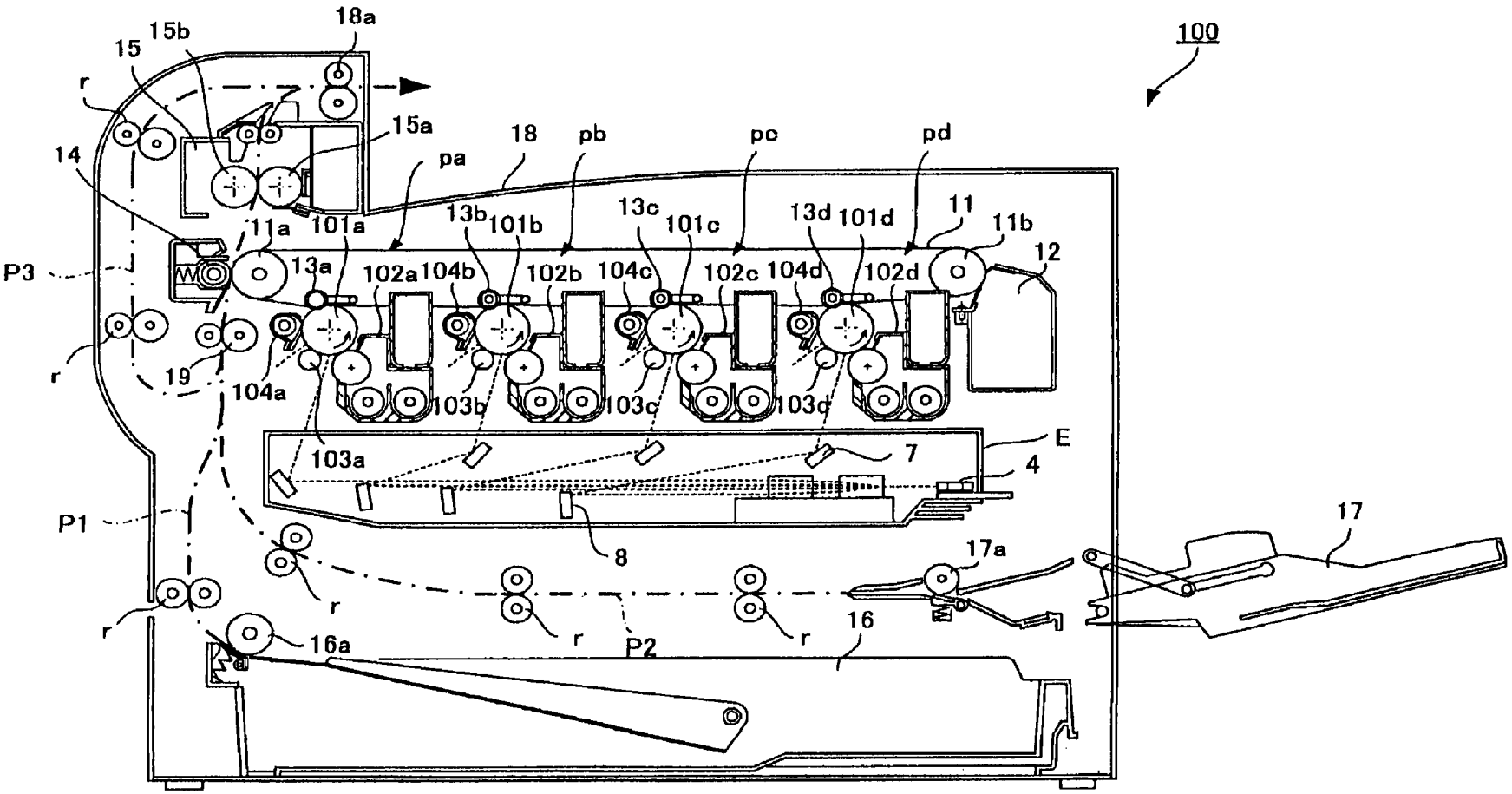
FIG. 1 is an illustrative view showing an entire configuration of an image forming apparatus according to an embodiment of the present invention.
Figure 2:
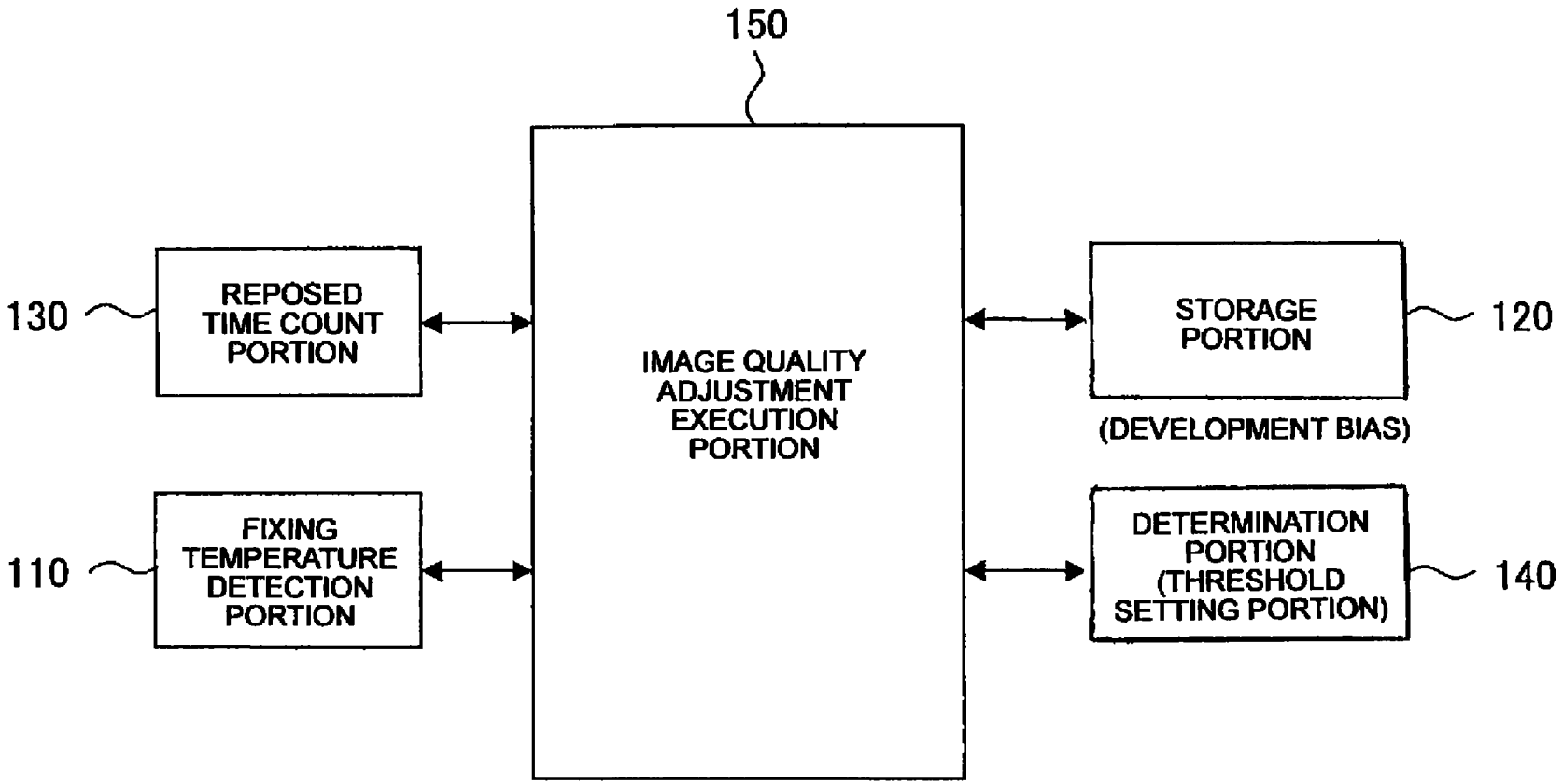
FIG. 2 is a block diagram showing an electrical configuration to perform adjustment of image quality in the image forming apparatus.

FIG. 1 is an illustrative view showing an entire configuration of an image forming apparatus according to an embodiment of the present invention, and FIG. 2 is a block diagram showing an electrical configuration to perform adjustment of image quality in the image forming apparatus.

An image forming apparatus 100 according to the present embodiment is an image forming apparatus by electrophotography having a function of adjusting image quality when image formation is performed, as shown in FIGS. 1 and 2.

The image forming apparatus 100 includes a detection portion 110 for detecting a fixing temperature of a fixing apparatus (fixing portion) 15, a storage portion 120 for storing an application history of a development bias applied between photoreceptor drums 101 and a developing apparatus 102, a count portion 130 for counting a reposed time from the point when an operation of image formation is ended, a determination portion 140 for determining a change range of the development bias immediately before the end of the operation of image formation, and an execution portion 150 for executing a function of adjusting image quality by setting the development bias based on a determination result from the determination portion 140 when the reposed time or the fixing temperature exceeds a predetermined value (threshold of reposed time, threshold of fixing temperature).

First, description will be given for the entire configuration of the image forming apparatus 100.

The image forming apparatus 100 forms a color or monochrome image on a sheet based on image data read from a document or on image data transmitted though a network or the like. Accordingly, the image forming apparatus 100 includes, as shown in FIG. 1, an exposure unit E, photoreceptor drums 101 (101*a* to 101*d*), developing apparatuses 102 (102*a* to 102*d*), charging rollers 103 (103*a* to 103*d*), cleaning units 104 (104*a* to 104*d*), an intermediate transfer belt 11, primary transfer rollers 13 (13*a* to 13*d*), a secondary transfer roller 14, a fixing apparatus 15, paper feed paths P1, P2, and P3, a paper feed cassette 16, a manual paper feed tray 17, a paper output tray 18, and the like.

The image forming apparatus 100 performs image formation at image forming portions Pa to Pd, by using image data corresponding to each of the four colors black (K), as well as cyan (C), magenta (M) and yellow (Y), which are the three subtractive primaries obtained by separating colors of a color image.

The image forming portions Pa to Pd are similar in configuration, and for example, the image forming portion Pa for black is configured by the photoreceptor drum 101*a*, the developing apparatus 102*a*, the charging roller 103*a*, the transfer roller 13*a*, the cleaning unit 104*a*, and the like. The image forming portions Pa to Pd are arranged in line in a moving direction (sub-scanning direction) of the intermediate transfer belt 11.

The charging rollers 103 are contact-type chargers for charging surfaces of the photoreceptor drums 101 to a predetermined electric potential. Instead of the charging rollers 103, contact-type chargers using a charging brush or non-contact-type chargers using a charging wire are also usable.

The exposure unit E which is an exposure apparatus of the present invention includes a unillustrated semiconductor laser, a polygon mirror 4, a first reflecting mirror 7, a second reflecting mirror 8, and the like, and irradiates the photoreceptor drums 101*a* to 101*d* with light beams, such as laser beams, that are modulated in accordance with image data for the respective colors black, cyan, magenta and yellow, respectively. On the respective photoreceptor drums 101*a* to 101*d*, electrostatic latent images are formed based on the image data for the respective colors black, cyan, magenta and yellow.

The developing apparatuses 102 feed toner to the surfaces of the photoreceptor drums 101 having the electrostatic latent images formed thereon, so that the electrostatic latent images are developed into toner images. The developing apparatuses 102*a* to 102*d* respectively contain toner of the respective colors black, cyan, magenta and yellow, and visualize each of the electrostatic latent images of the respective colors formed on the photoreceptor drums 101*a* to 101*d* into toner images of the respective colors black, cyan, magenta and yellow. The cleaning units 104 remove and collect toner remaining on the surfaces of the photoreceptor drums 101 after development and image transfer.

The intermediate transfer belt 11 disposed above the photoreceptor drums 101 is stretched around a driving roller 11*a* and a driven roller 11*b*, and forms a loop-shaped moving path. The outer circumferential surface of the intermediate transfer belt 11 faces the photoreceptor drum 101*d*, the photoreceptor drum 101*c*, the photoreceptor drum 101*b* and the photoreceptor drum 101*a* in this order. The primary transfer rollers 13*a* to 13*d* are disposed at positions facing the respective photoreceptor drums 101*a* to 101*d* across the intermediate transfer belt 11. The positions at which the intermediate transfer belt 11 faces each of the photoreceptor drums 101*a* to 101*d* are primary transfer positions. Moreover, the intermediate transfer belt 11 is formed by a film having thickness of around 100 to 150 μm.

A primary transfer bias with the opposite polarity to the charging polarity of toner is applied to the primary transfer rollers 13*a* to 13*d* by constant voltage control in order to transfer the toner images carried on the surfaces of the photoreceptor drums 101*a* to 101*d* onto the intermediate transfer belt 11. Thus, the toner images of the respective colors formed on the photoreceptor drums 101 (101*a* to 101*d*) are overlapped and transferred onto the outer circumferential surface of the intermediate transfer belt 11 sequentially, and a full-color toner image is formed on the outer circumferential surface of the intermediate transfer belt 11.

However, when image data for only a part of the colors yellow, magenta, cyan and black is input, electrostatic latent images and toner images are formed by only a part of the photoreceptors 101 corresponding to the colors of the input image data among the four photoreceptor drums 101*a* to 101*d*. For example, during monochrome image formation, an electrostatic latent image and a toner image are formed only by the photoreceptor drum 101*a* corresponding to black color, and only a black toner image is transferred onto the outer circumferential surface of the intermediate transfer belt 11.

The respective primary transfer rollers 13*a* to 13*d* have a configuration in which the surface of an axis made of a metal (stainless steel, for example) with a diameter of 8 to 10 mm is coated with a conductive elastic material (EPDM, urethane foam or the like, for example), and uniformly apply a high voltage to the intermediate transfer belt 11 by the conductive elastic material.

The toner image transferred onto the outer circumferential surface of the intermediate transfer belt 11 at each of the primary transfer positions is transported to a secondary transfer position, which is a position facing the secondary transfer roller 14, by the rotation of the intermediate transfer belt 11. The secondary transfer roller 14 is pressed, at a predetermined nip pressure, against the outer circumferential surface of the intermediate transfer belt 11 whose inner circumferential surface is in contact with the circumferential surface of the driving roller 11*a* during image formation.

While a sheet fed from the paper feed cassette 16 or the manual paper feed tray 17 passes between the secondary transfer roller 14 and the intermediate transfer belt 11, a high voltage with the opposite polarity to the charging polarity of toner is applied to the secondary transfer roller 14. Thus, the toner image is transferred from the outer circumferential surface of the intermediate transfer belt 11 to the surface of the sheet.

Note that, of the toner adhered from the photoreceptor drums 101 to the intermediate transfer belt 11, toner that has not been transferred onto the sheet and remains on the intermediate transfer belt 11 is collected by the cleaning unit 12 in order to prevent color mixture in the following process.

The sheet onto which the toner image has been transferred is guided to the fixing apparatus 15 so as to pass between a heat roller 15*a* and a pressing roller 15*b* to be heated and pressed. Thus, the toner image is firmly fixed on the surface of the sheet. The sheet on which the toner image has been fixed is discharged by a paper output roller 18*a* to the paper output tray 18.

The image forming apparatus 100 is provided with the paper feed path P1 in the almost vertical direction so that a sheet contained in the paper feed cassette 16 is sent through between the secondary transfer roller 14 and the intermediate transfer belt 11, and through the fixing apparatus 15, to the paper output tray 18.

On the paper feed path P1, disposed are a pick-up roller 16*a* for sending sheets in the paper feed cassette 16 to the paper feed path P1 one by one, a transport roller r for transporting the sent sheet upward, a registration roller 19 for guiding the transported sheet between the secondary transfer roller 14 and the intermediate transfer belt 11 at a predetermined timing, and the paper output roller 18*a* for discharged the sheet to the paper output tray 18.

Furthermore, inside the image forming apparatus 100, the paper feed path P2 on which a pick-up roller 17*a* and transport rollers r are disposed is formed between the manual paper feed tray 17 and the registration roller 19. In addition, the paper feed path P3 is formed between the paper output roller 18*a* and the upstream side of the registration roller 19 on the paper feed path P1.

The paper output roller 18*a* rotates freely in both the forward and the reverse directions, and is driven in the forward direction to discharge a sheet to the paper output tray 18 during single-sided image formation in which an image is formed on one side of sheet and during second side image formation of dual-sided image formation in which images are formed on both sides of sheet.

On the other hand, during first side image formation of the dual-sided image formation, the paper output roller 18*a* is driven in the forward direction until the rear edge of the sheet passes through the fixing apparatus 15, and is then driven in the reverse direction to guide the sheet to the paper feed path P3 while holding the rear edge of the sheet. Thus, the sheet on which an image is formed only on one side during dual-sided image formation is guided to the paper feed path P1 in a state where the sheet is turned over and upside down.

The sheet that has been fed from the paper feed cassette 16 or the manual paper feed tray 17, or has been transported through the paper feed path P3 is guided by the registration roller 19 between the secondary transfer roller 14 and the intermediate transfer belt 11 at a timing that is synchronized with the rotation of the intermediate transfer belt 11. Thus, the rotation of the registration roller 19 is stopped after the operation of the photoreceptor drums 101 or the intermediate transfer belt 11 is started, and the movement of the sheet that has been fed or transported prior to the rotation of the intermediate transfer belt 11 is stopped on the paper feed path P1 in a state where the front edge abuts against the registration roller 19. Then, the rotation of the registration roller 19 is started at a timing when the front edge of the sheet faces the front edge of a toner image formed on the intermediate transfer belt 11, at a position where the secondary transfer roller 14 is pressed against the intermediate transfer belt 11.

Note that, during full-color image formation in which image formation is performed by all of the image forming portions Pa to Pd, all of the primary transfer rollers 13*a* to 13*d* press the intermediate transfer belt 11 against the photoreceptor drums 101*a* to 101*d*. On the other hand, during monochrome image formation in which image formation is performed only by the image forming portion Pa, only the primary transfer roller 13*a* presses the intermediate transfer belt 11 against the photoreceptor drum 101*a*.

Next, description will be given for an electrical configuration to perform characteristic image adjustment in the image forming apparatus 100 according to the present embodiment.

The image forming apparatus 100 according to the present embodiment includes, as shown in FIG. 2, the detection portion 110 for detecting a fixing temperature of the fixing apparatus (fixing portion) 15, the storage portion 120 for storing an application history of a development bias of the developing apparatus 102, the count portion 130 for counting a reposed time from the point when an operation of image formation is ended, the determination portion 140 for determining a change range of the development bias immediately before the end of the operation of image formation, and the execution portion 150 for executing a function of adjusting image quality by setting the development bias based on a determination result from the determination portion 140 when the reposed time or the fixing temperature exceeds a predetermined value (threshold of reposed time, threshold of fixing temperature).

The execution portion 150 has a function of setting an effective development potential based on the determination result from the determination portion 140 when the reposed time from the point when the operation of image formation in the image forming apparatus 100 is ended or the fixing temperature exceeds the predetermined value (threshold of reposed time, threshold of fixing temperature), as well as a function of setting the development bias based on an average printing rate.

The determination portion 140 has a function of determining the change range based on a rise range of the development bias of the developing apparatus 102.

Here, description will be given for operational control for the image forming apparatus 100 according to the present embodiment with reference to the flowchart.

Figure 3:
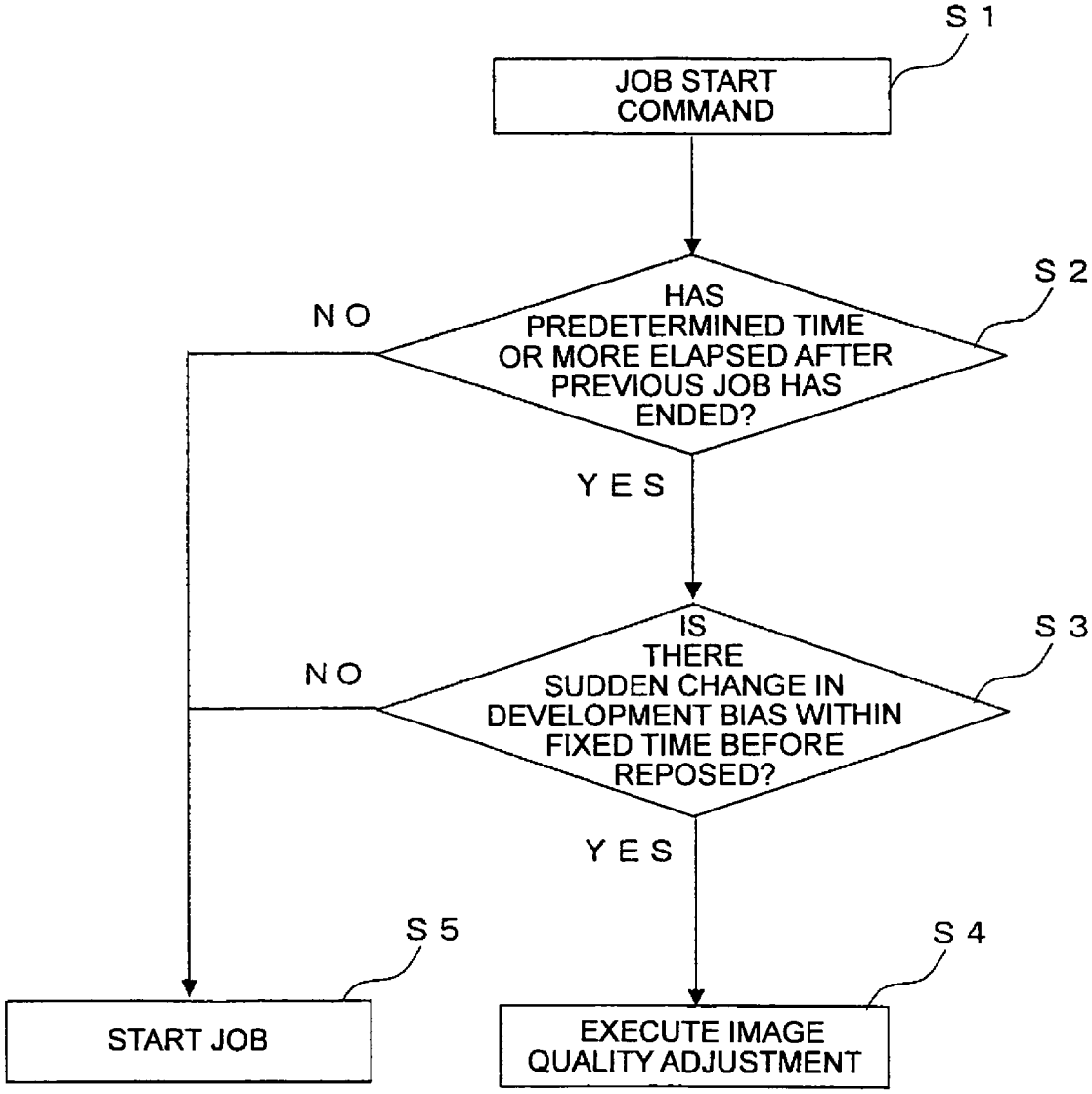
FIG. 3 is a flowchart showing control of image adjustment in image formation of the image forming apparatus.

FIG. 3 is a flowchart showing control of image adjustment in image formation in the image forming apparatus according to the present embodiment.

First, when the image forming apparatus 100 starts an operation and image formation is requested by an instruction from a user, as shown in FIG. 3, a normal print job command is started (step S1) and whether or not it has elapsed over a predetermined time (threshold of reposed time) or more from the end of a previous job is determined (step S2).

Specifically, at step S2, whether or not a reposed time that the image forming apparatus 100 is reposed in a state of non-operation is a predetermined time (an hour, for example) or more is determined.

At step S2, when it is determined that the reposed time is short (not reposed for a long time: less than threshold of reposed time), the print job is started as it is (step S5).

On the other hand, at step S2, when it is determined that the reposed time is an hour or more (reposed time is long: threshold of reposed time or more), whether or not the development bias within a fixed time before reposed (range of time before reposed), for example, for 10 minutes before reposed is suddenly changed is determined (step S3).

The sudden change in the development bias is caused by continuous printing of a document of low printing rate as described above. Thus, in order to determine whether or not to be reposed after continuous printing of a document of a low printing rate, at step S3, the development bias within the range of time before reposed is read by the determination portion 140 from the history of the development bias stored in the storage portion 120 and determination is performed based on whether or not there is a change range in which an image density is changed greatly (threshold of change range of development bias), for example, whether or not the development bias is changed by 100 V or more.

At step S3, when the determination portion 140 determines that there is no sudden change in the development bias within the range of time before reposed, the print job is started as it is (step S5).

On the other hand, at step S3, when the determination portion 140 determines that there is a sudden change in the development bias within a range of time before reposed, the procedure proceeds to step S4 and adjustment of image quality (process control) that has been previously set is executed.

In this way, in printing processing after the image forming apparatus 100 has been reposed, it is possible to suppress the phenomenon in which a printing image density is abnormally dense (high).

Next, as a modified example of the present embodiment, description will be given for operational control in image formation when image adjustment in the image forming apparatus 100 according to the present embodiment is performed in view of a fixing temperature.

Figure 4:
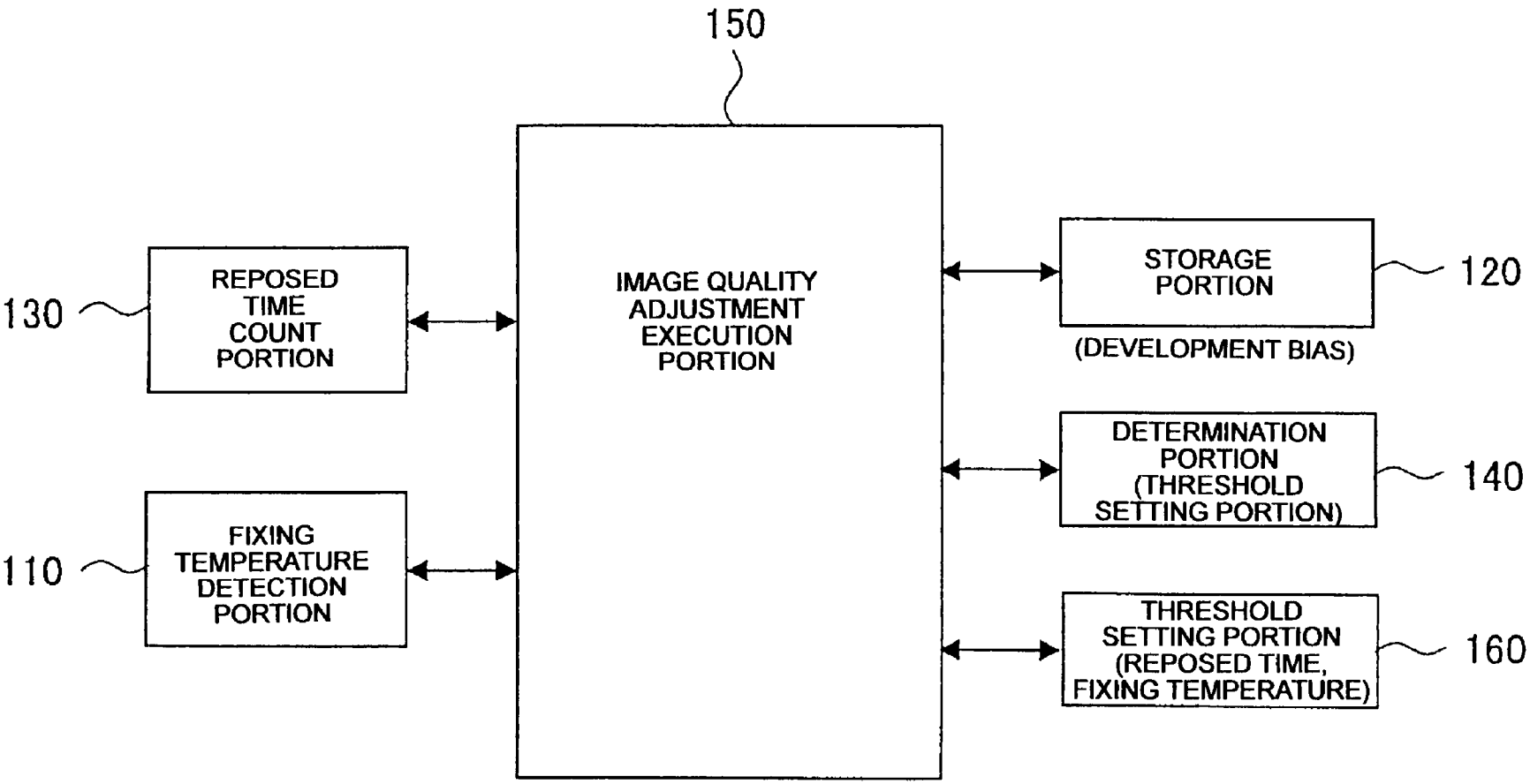
FIG. 4 is a block diagram showing an electrical configuration to perform adjustment of image quality in a modified example of the image forming apparatus.
Figure 5:
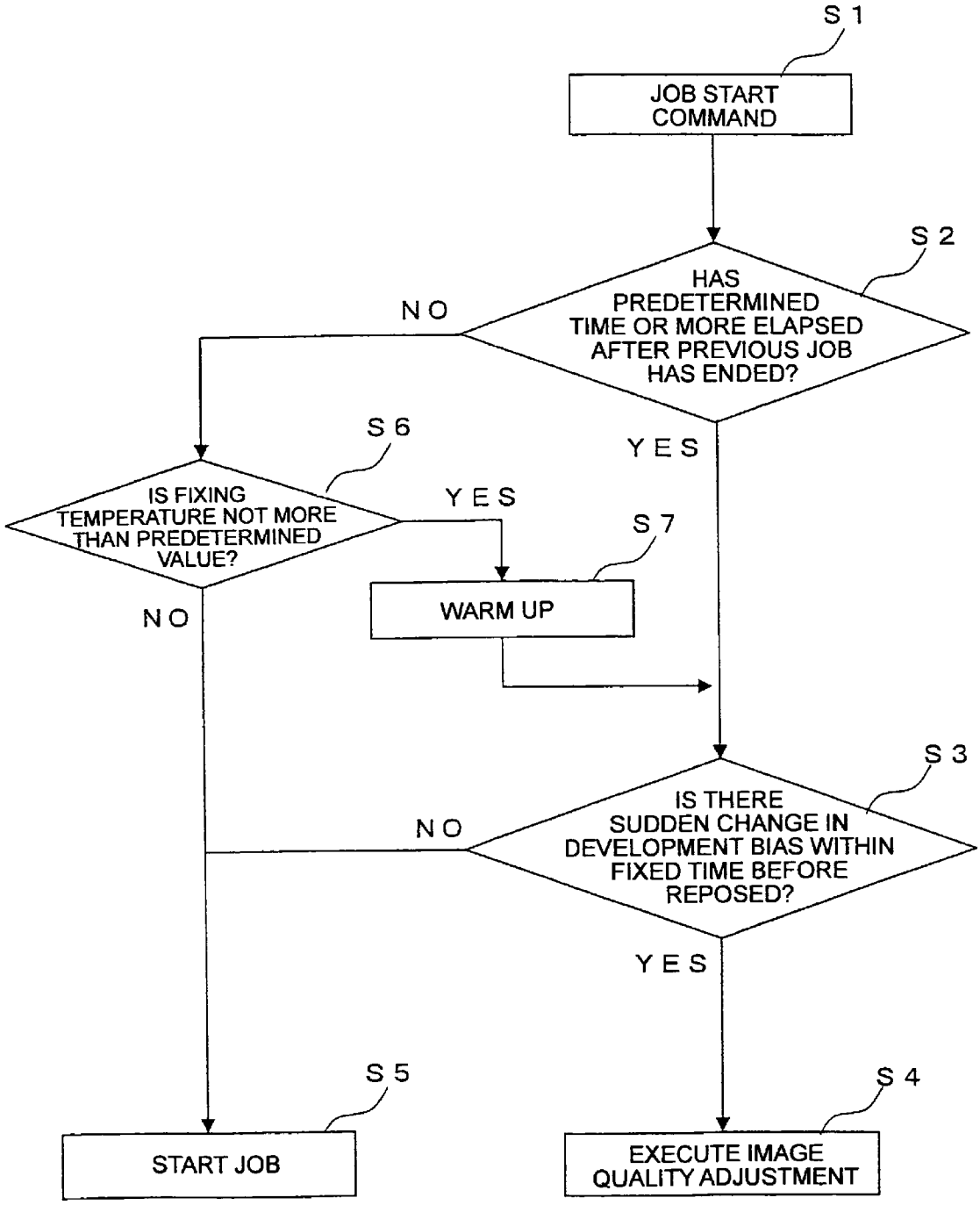
FIG. 5 is a flowchart showing control of image adjustment in the modified example.

FIG. 4 is a block diagram showing an electrical configuration to perform adjustment of image quality in the modified example of the image forming apparatus according to the present embodiment, and FIG. 5 is a flowchart showing control of image adjustment in the above-described modified example.

The modified example shows, as shown in FIG. 4, a configuration in which a setting portion 160 is added to the configuration of FIG. 2.

That is, the electrical configuration in the modified example is such that the detection portion 110 for detecting a fixing temperature of the fixing apparatus 15, the storage portion 120 for storing an application history of a development bias of the developing apparatus 102, the count portion 130 for counting a reposed time from the point when an operation of image formation is ended, the determination portion 140 for determining a change range of the development bias immediately before the end of the operation of image formation, the execution portion 150 for executing a function of adjusting image quality by setting the development bias based on a determination result from the determination portion 140 when the reposed time or the fixing temperature exceeds a predetermined value (threshold of reposed time, threshold of fixing temperature), and, as a configuration of the execution portion for performing image adjustment, the setting portion 160 for setting a length of the reposed time (threshold of reposed time) or a reduction range of the fixing temperature of the fixing apparatus 15 (threshold of fixing temperature). The setting portion 160 has a function of changing the threshold of reposed time and threshold of fixing temperature with respect to deterioration in developer.

Next, description will be given for operational control for the image forming apparatus 100 according to the modified example with reference to the flowchart.

The operation up to step 2 in the modified example is carried out, as shown in FIG. 5, in the similar manner to the image forming apparatus 100 according to the above-described embodiment (see FIG. 3), but in the flowchart in the modified example, operational control is performed based on the fixing temperature (including a reduction range of the fixing temperature) of the fixing apparatus 15 simultaneously.

This is because, even when the reposed time of the image forming apparatus 100 is short, due to an operational state of the image forming apparatus 100, the fixing temperature of the fixing apparatus 15 can be reduced depending on the use condition of the previous print job.

Hence, after a print job command is started (step S1), when it is determined that the reposed time is short (not reposed for a long time) at step S2, the procedure proceeds to step S6 and it is determined whether or not the fixing temperature of the fixing apparatus 15 (detected temperature of the detection portion 110) is a predetermined temperature (threshold of fixing temperature), for example, 60° C. or less.

At step S6, when it is determined that the fixing temperature is not 60° C. or less, the print job is started as it is (step S5).

On the other hand, when it is determined that the fixing temperature is 60° C. or less, for example, a unillustrated fixing heater provided in the fixing apparatus 15 or the like is turned on and an operation of increasing the fixing temperature is performed (step S7). Since the reposed time is short, the fixing temperature is recovered to a target level soon in this increasing operation, the procedure then proceeds to step S3 and the operation is performed in the similar manner to the image forming apparatus 100 according to the above-described embodiment.

In this way, in printing processing after the image forming apparatus 100 has been reposed, it is possible to suppress the phenomenon in which a printing image density is abnormally dense (high).

Note that, in the image forming apparatus 100 using dual-component developer, as images are output, deterioration in developer is generated. Then, as developer is deteriorated, the charging property of toner is reduced.

Hence, as shown in FIG. 6, it is possible to perform adjustment of image quality more frequently by shortening the threshold of reposed time in accordance with a life of developer.

For example, it is possible to set relationship between a life of developer and the reposed time (threshold of reposed time) as shown in FIG. 6. That is, the life of developer is converted into the image output number by a recording medium so that, for example, the reposed time (threshold of reposed time) up to 10,000 sheets of image output is 60 minutes, the reposed time from 10,000 sheets up to 20,000 sheets is 65 minutes, the reposed time from 20,000 sheets up to 30,000 sheets is 70 minutes, the reposed time from 30,000 sheets up to 40,000 sheets is 80 minutes, the reposed time from 40,000 sheets up to 50,000 sheets is 90 minutes, and the reposed time exceeding 50,000 sheets is 100 minutes.

In this way, by setting the threshold of the reposed time in accordance with the life of developer, it is possible to always maintain high image quality through the life of developer.

According to the present embodiment thus configured as described above, by confirming information of a previous print job every time of returning from a reposed state when the operation of the image forming apparatus 100 is started, it is possible to perform adjustment of image quality accurately. Thus, it is possible to always output an image excellent in image quality by accurate adjustment of image quality.

Note that, the present invention is not limited to an image forming apparatus or a copier having the configuration as described above, and is applicable to other image forming apparatuses as far as an image forming apparatus has a function of adjusting image quality when performing image formation.

For example, the present invention is also applicable to an image forming apparatus having a function of making an alarming display as operational control for the image forming apparatus. According to this image forming apparatus, in adjustment of image quality from a reposed state, when a change range (rise range) of a development bias exceeds a predetermined value (threshold of change range of the development bias) it is possible to make an alarming display, such as "Image quality is being adjusted now. Please wait for a while." on a monitor.

This enables to announce the operational state of the apparatus to a user, including determination of whether or not the image forming apparatus itself is in trouble.

Moreover, as another example, the image forming apparatus may be provided with a selection switch for allowing ON/OFF operations in the execution portion for adjusting image quality to be switched.

According to this configuration, it is possible not to perform adjustment of image quality in the present embodiment for a user who desires emergency printing in a short time, and this allows use in two ways.

As described above, the present invention will not be limited to above described embodiments and many alterations can be made within the scope described in the claims. Thus, an embodiment obtained by combining technical means that are appropriately changed within the scope described in the claims is also covered by the technical scope of the present invention.

What is claimed is:

1. An image forming apparatus by electrophotography having a function of performing adjustment of image quality when performing image formation, comprising:

a detection portion for detecting a fixing temperature of a fixing portion;

a storage portion for storing an application history of a development bias;

a count portion for counting a reposed time from a point when an operation of image formation is ended;

a determination portion for determining a change range of the development bias immediately before the end of the operation of image formation, wherein said change range is a rise range; and an execution portion for executing adjustment of image quality by setting the development bias based on a determination result from the determination portion when the reposed time or the fixing temperature exceeds a predetermined value.

2. The image forming apparatus according to claim 1, wherein, when the reposed time or the fixing temperature exceeds a predetermined value, the execution portion sets an effective development potential based on the determination result from the determination portion.

3. The image forming apparatus according to claim 1, wherein the execution portion sets the development bias on an average printing rate.

4. The image forming apparatus according to claim 1, wherein the change range is a range wherein a large variation occurs in an image density.

5. The image forming apparatus according to claim 1, comprising a setting portion for setting the predetermined value.

6. The image forming apparatus according to claim 5, wherein the setting portion changes the predetermined value based on deterioration in developer.

7. A method for controlling an image forming apparatus by electrophotography having a function of performing adjustment of image quality when performing image formation, comprising:

a detection step of detecting a fixing temperature of a fixing portion;

a storage step of storing an application history of a development bias;

a count step of counting a reposed time from a point when an operation of image formation is ended;

a determination step of determining a change range of the development bias immediately before the end of the operation of image formation, wherein said change range is a rise range; and an execution step of executing adjustment of image quality by setting the development bias based on a determination result from the determination portion when the reposed time or the fixing temperature exceeds a predetermined value.

8. The method for controlling the image forming apparatus according to claim 7, wherein, when the reposed time or the fixing temperature exceeds a predetermined value, at the execution step, an effective development potential is set based on the determination result at the determination step.

9. The method for controlling the image forming apparatus according to claim 7, wherein the development bias is set based on an average printing rate at the execution step.

10. The method for controlling the image forming apparatus according to claim 7, wherein the change range is a rise range wherein a large variation occurs in an image density.

11. The method for controlling the image forming apparatus according to claim 7, comprising a setting step of setting the predetermined value.

12. The method for controlling the image forming apparatus according to claim 7, wherein the predetermined value is changed based on deterioration in developer at the setting step.

* * * * *